US010367306B2

(12) United States Patent
Matroja

(10) Patent No.: US 10,367,306 B2
(45) Date of Patent: Jul. 30, 2019

(54) COMMUNICATION CONNECTOR AND COMMUNICATION CONNECTOR WITH WIRES

(71) Applicants: AutoNetworks Technologies, Ltd., Yokkaichi, Mie (JP); Sumitomo Wiring Systems, Ltd., Yokkaichi, Mie (JP); SUMITOMO ELECTRIC INDUSTRIES, LTD., Osaka-shi, Osaka (JP)

(72) Inventor: Rhushik Matroja, Mie (JP)

(73) Assignees: AutoNetworks Technologies, Ltd. (JP); Sumitomo Wiring Systems, Ltd. (JP); Sumitomo Electric Industries, Ltd. (JP)

( * ) Notice: Subject to any disclaimer, the term of this patent is extended or adjusted under 35 U.S.C. 154(b) by 0 days.

(21) Appl. No.: 15/756,159

(22) PCT Filed: Sep. 5, 2016

(86) PCT No.: PCT/JP2016/075957
§ 371 (c)(1),
(2) Date: Feb. 28, 2018

(87) PCT Pub. No.: WO2017/043435
PCT Pub. Date: Mar. 16, 2017

(65) Prior Publication Data

US 2018/0248319 A1 Aug. 30, 2018

(30) Foreign Application Priority Data

Sep. 9, 2015 (JP) ..... 2015-177275

(51) Int. Cl.
*H01R 13/658* (2011.01)
*H01R 13/6473* (2011.01)
(Continued)

(52) U.S. Cl.
CPC ..... *H01R 13/6473* (2013.01); *H01R 9/035* (2013.01); *H01R 13/502* (2013.01); *H01R 13/6582* (2013.01); *H01R 13/6592* (2013.01)

(58) Field of Classification Search
CPC ..... H01R 13/658; H01R 13/6585; H01R 13/6586; H01R 23/688; H01R 9/0506; H01R 9/0518
(Continued)

(56) References Cited

U.S. PATENT DOCUMENTS 5,718,607 A * 2/1998 Murphy ..... H01R 9/038 439/579
5,785,555 A * 7/1998 O'Sullivan ..... H01R 4/187 439/108
6,328,601 B1 12/2001 Yip et al.
6,380,485 B1 * 4/2002 Beaman ..... H01R 9/035 174/88 R
6,722,898 B2 * 4/2004 Peloza ..... H01R 13/6473 439/108
(Continued)

FOREIGN PATENT DOCUMENTS

JP 2006-114337 4/2006
JP 2008-507110 3/2008
(Continued)

OTHER PUBLICATIONS

International Search Report dated Nov. 22, 2016.

*Primary Examiner* — Hien D Vu
(74) *Attorney, Agent, or Firm* — Gerald E. Hespos; Michael J. Porco; Matthew T. Hespos

(57) ABSTRACT

A communication connector (30) includes terminals (31) to be connected to wires (12 to 18), including first wires (12, 13) and second wires (14, 15) capable of faster communication than the first wires (12, 13). The wires (12 to 18) form first and second wire rows (22A, 22B). A housing (35)
(Continued)

accommodates the terminals (31). A conductive wire holding member (40) holds relative positions of the second wires (14, 15) on one end of the first wire row (22A) in an arrangement direction and the second wires (14, 15) on an opposite end of the second wire row (22B). The wire holding member (40) has dividing members (41A, 41B) configured to surround the second wires (14, 15) when the dividing members (41A, 41B) are assembled.

9 Claims, 13 Drawing Sheets

(51) Int. Cl.

| | |
|---|---|
| *H01R 9/03* | (2006.01) |
| *H01R 13/502* | (2006.01) |
| *H01R 13/6582* | (2011.01) |
| *H01R 13/6592* | (2011.01) |

(58) Field of Classification Search
USPC ..... 439/607.05, 579, 585
See application file for complete search history.

(56) References Cited

U.S. PATENT DOCUMENTS

| | | | | |
|---|---|---|---|---|
| 6,991,493 | B2 * | 1/2006 | Matsui | H01R 4/64 439/579 |
| 7,909,647 | B2 * | 3/2011 | Kawaguchi | H01R 9/035 439/585 |
| 2006/0014431 | A1 | 1/2006 | Shuey et al. | |
| 2010/0048045 | A1 | 2/2010 | Tanaka | |
| 2011/0300750 | A1 | 12/2011 | Nagawatari et al. | |

FOREIGN PATENT DOCUMENTS

| | | |
|---|---|---|
| JP | 2010-49961 | 3/2010 |
| JP | 2012-18898 | 1/2012 |
| WO | 99/17406 | 4/1999 |

* cited by examiner

COMMUNICATION CONNECTOR AND COMMUNICATION CONNECTOR WITH WIRES

BACKGROUND

Field of the Invention

This specification relates to communication connectors.

Description of the Related Art

Japanese Unexamined Patent Publication No. 2008-507110 discloses an electrical connector capable of receiving four USB plug connectors. This electrical connector includes a housing, electrical contacts made of L-shaped metal pieces, an outer shield and an inner shield. Electrical contacts are fixed side by side in a lateral direction for each USB plug connector.

A cable may be used as a conductor instead of a metal bar and has wires exposed at an end part of the cable where a coating is removed. Intervals between the wires easily change in this part where the wires are exposed, and impedance change points of the wires are created to reflect signals. Thus, communication quality may be reduced.

This specification discloses a communication connector that suppresses a reduction of communication quality.

SUMMARY

A communication connector disclosed in this specification includes terminals to be connected to wires including first wires and second wires capable of faster communication than the first wires. The wires form wire rows. The communication connector further includes a housing for accommodating the terminals, and a conductive wire holding member for holding relative positions of the second wire on a first end of the wire row in an arrangement direction and the second wire on a second end opposite to the first end of the wire row different from the former wire row. The wire holding member has dividing members and is configured to surround the second wires with the dividing members assembled.

According to this configuration, the second wires are surrounded by the conductive wire holding member while the relative positions of the second wires diagonally arranged in the different wire rows are held. Thus, potentials among the wires are stabilized for the second wires positioned to easily change impedance between the wires and impedance changes of the second wires can be suppressed. The reflection of signals at impedance change points can be suppressed in this way, and therefore a reduction of communication quality can be suppressed.

Further, the wire holding member is configured to surround the second wires with the dividing members assembled. Thus, an operation of inserting the wires through the wire holding member can be simplified.

If the plurality of terminals are arranged in a single row in the housing, the communication connector tends to be long in the arrangement direction of the terminals. Thus, an arrangement space is likely to be restricted. On the other hand, according to this embodiment, the wires constitute the plurality of wire rows. Therefore, the communication connector has a compact shape and the arrangement space is less likely to be restricted.

Each wire row may include a plurality of the second wires adjacent to each other, and each dividing member may include a first wall for partitioning the second wire on an outer side and the outside, and a second wall for partitioning between the adjacent second wires. Thus, impedance changes of the wires can be suppressed by a simple configuration.

Each wire row may include a plurality of the second wires adjacent to each other. At least one dividing member may include first walls for partitioning the second wire on an outer side and second walls for partitioning between the adjacent second wires in each wire row. Thus, an assembling operation in disposing and assembling the wires between the dividing members can be facilitated.

A communication connector with wires includes the above-described communication connector and wires to be connected to the terminals.

The communication connector disclosed in this specification suppresses a reduction of communication quality.

DETAILED DESCRIPTION

<First Embodiment>

A first embodiment is described with reference to FIGS. 1 to 8.

A communication connector with wires 10 is installed in a vehicle, such as an electric or hybrid vehicle, and is disposed in a wired communication path between an in-vehicle electrical component (navigation system, ETC, monitor or the like) and an external device (camera or the like) or between in-vehicle electrical components in the vehicle. In the following description, an X direction is a rightward direction, a Y direction is an upward direction and a Z direction is a forward direction.

(Communication Connector with Wires 10)

Figure 1:
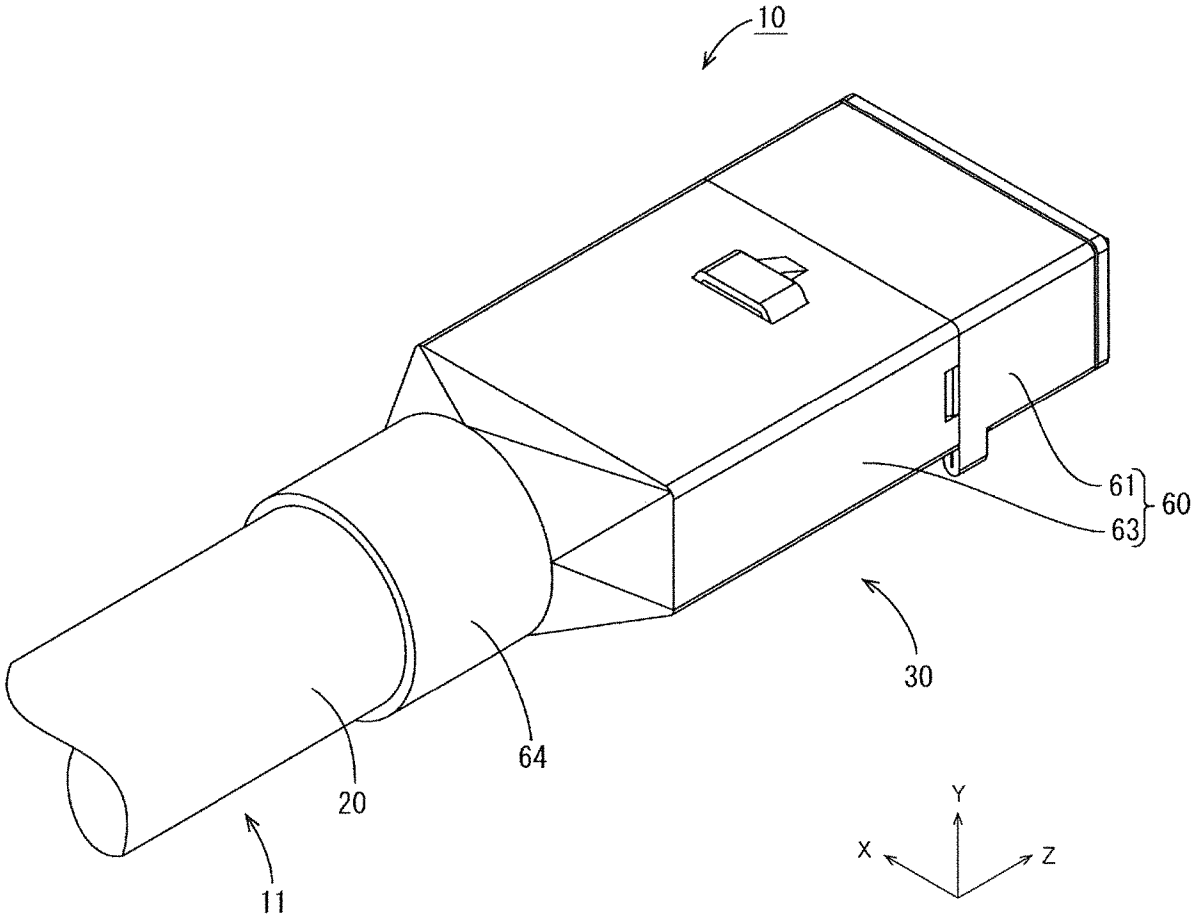
FIG. 1 is a perspective view showing a communication connector with wires of a first embodiment.

The communication connector with wires 10 includes, as shown in FIG. 1, a cable 11 and a communication connector 30 provided on an end part of the cable 11.

(Cable 11)

Figure 2:
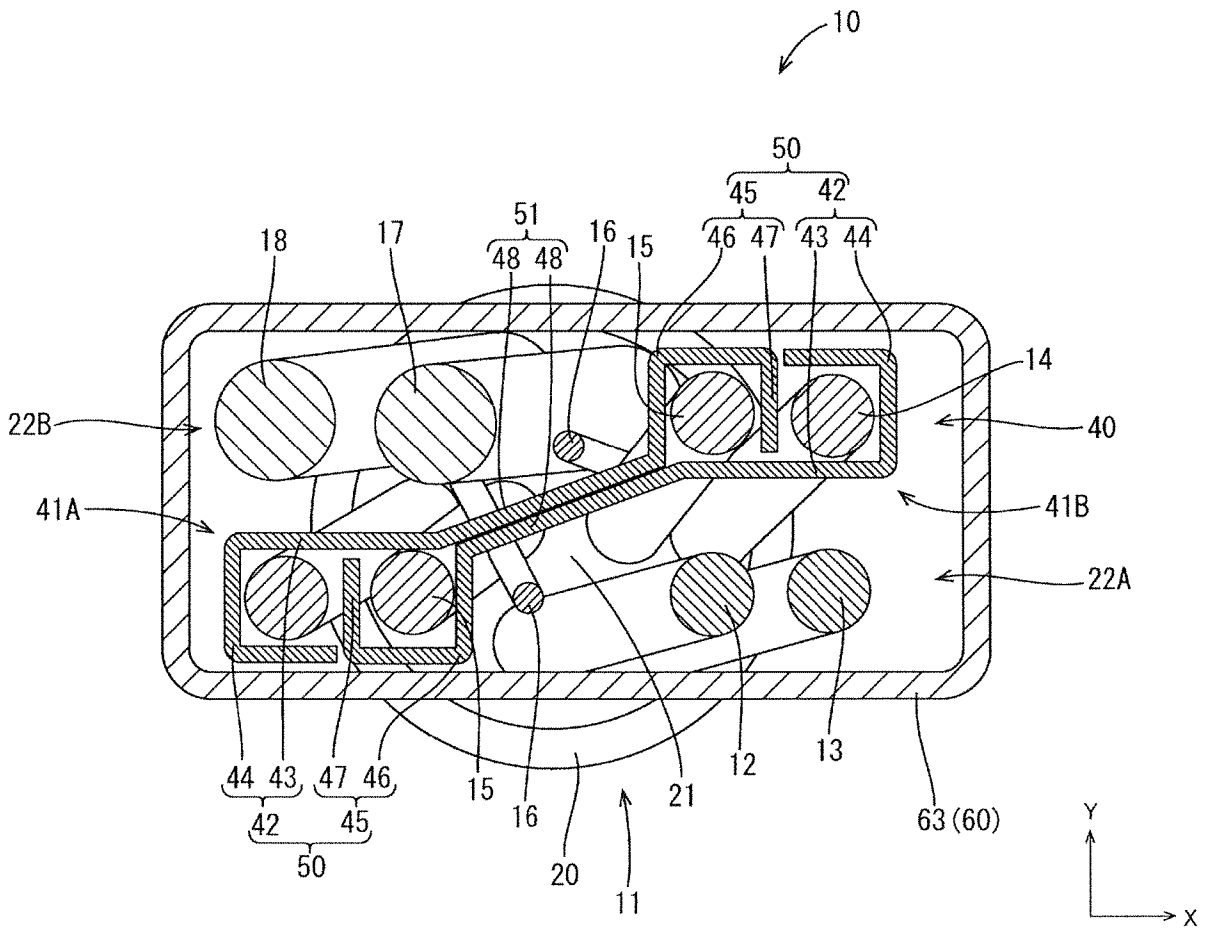
FIG. 2 is a section showing the communication connector with wires.

The cable 11 is capable of high-speed communication of 1 Ghz or faster and includes, as shown in FIG. 2, wires 12 to 18 and an insulating coating 20 for collectively surrounding the wires 12 to 18. A shield layer (not shown) formed by braiding thin metal wires collectively surrounds the wires 12 to 18 inside the coating 20. A filling 21 for filling up clearances by packing insulating threads, paper tapes or the like is filled inside this shield layer.

The wires 12 to 18 are composed of first wires 12, 13 for communication (communicable wires), second wires 14, 15 capable of faster communication than the first wires 12, 13, two drain wires 16, one power supply wire 17 to be connected to a power supply and one ground wire 18 to be connected to a ground potential. The first wires 12, 13 define a pair of wires (twisted pair without a shield) and, in this embodiment, are USB (Universal Serial Bus) 2.0 standard wires. The second wires 14, 15 are two pairs of wires different in type from the first wires 12, 13, and constitute high-speed wire pairs (differential pairs with a shield and a drain wire) having a fast maximum data transfer rate and are, in this embodiment, of USB 3.0 standard and, for example, capable of a transfer of 5 Gbps.

Five end parts of the wires 12 to 18 drawn out from an end part of the coating 20 and exposed are arranged side by side in the lateral direction to form upper and lower wire rows 22A, 22B. In the wire row 22A, the adjacent second wires 14, 15 are disposed on a left end part (end part on a first side in an arrangement direction). In the wire row 22B, the adjacent second wires 14, 15 are disposed on a right end part (end part on a second side opposite to the first side in the arrangement direction).

Figure 8:
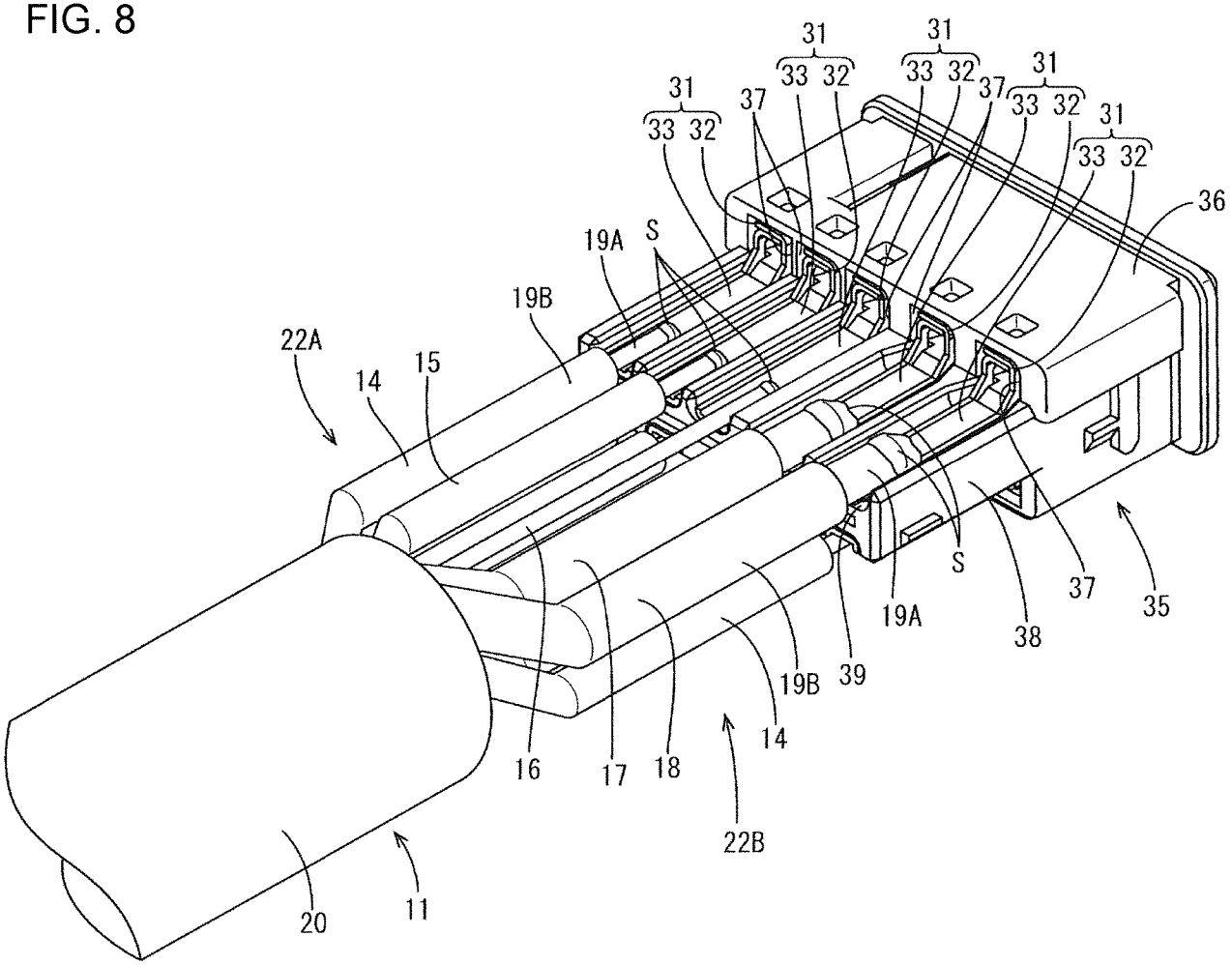
FIG. 8 is a perspective view showing the communication connector with wires in a state where the shield connector and the wire holding member are removed.

The wires 12 to 18 differ in outer diameter depending on the types, twisted pair cables are used and parts of the wires 12 to 18 exposed by removing the coating 20 are untwisted. Note that twisted pair cables need not be used as the wires 12 to 18. Further, as shown in FIG. 8, each wire 12 to 18 has a conductor 19A made of metal covered with an insulation layer 19B made of insulating synthetic resin. The insulation layer 19B is stripped at an end of the wire 12 to 18 to expose the conductor 19A to be connected to a terminal 31.

(Communication Connector 30)

Figure 3:
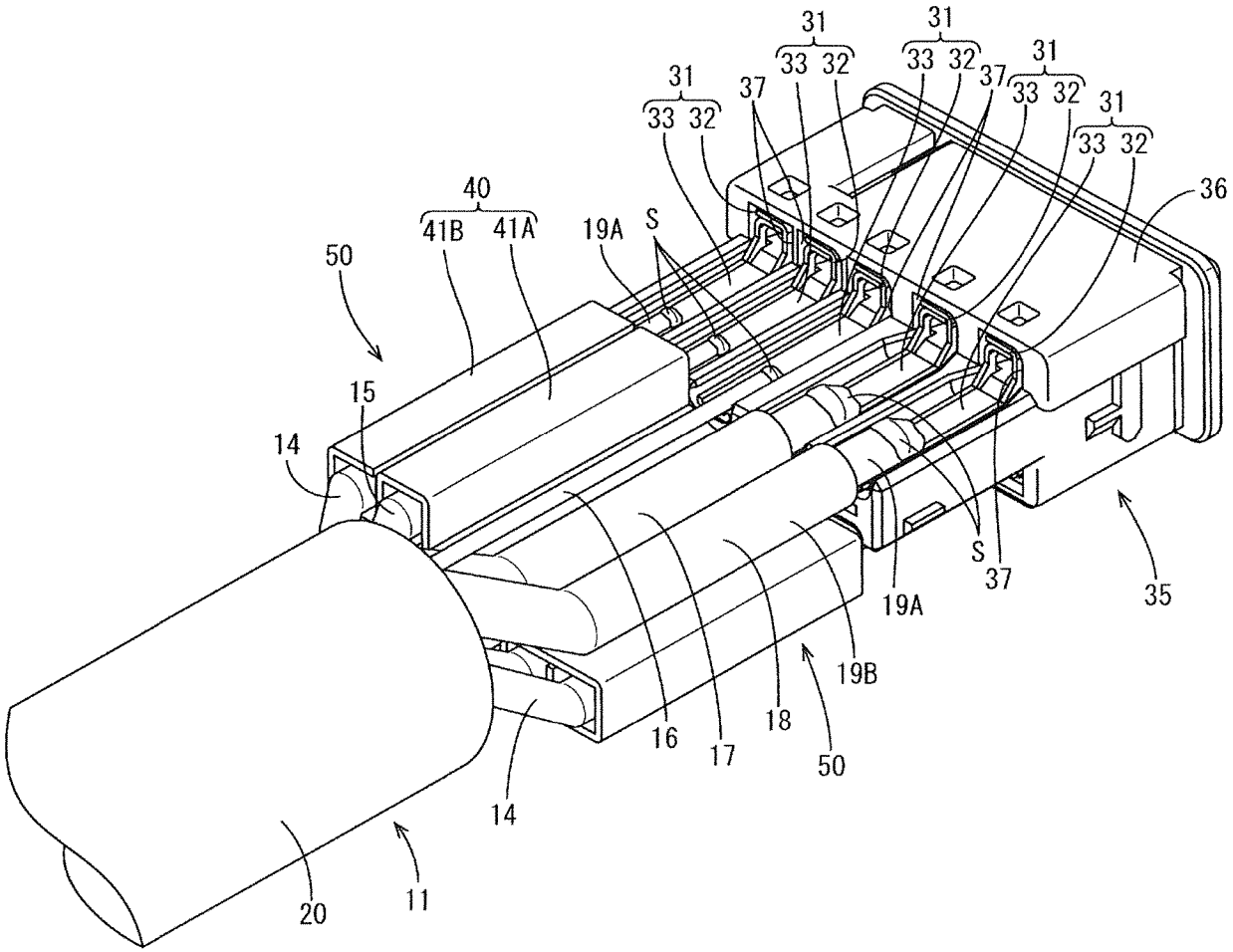
FIG. 3 is a perspective view showing the communication connector with wires in a state where a shield case is removed.
Figure 4:
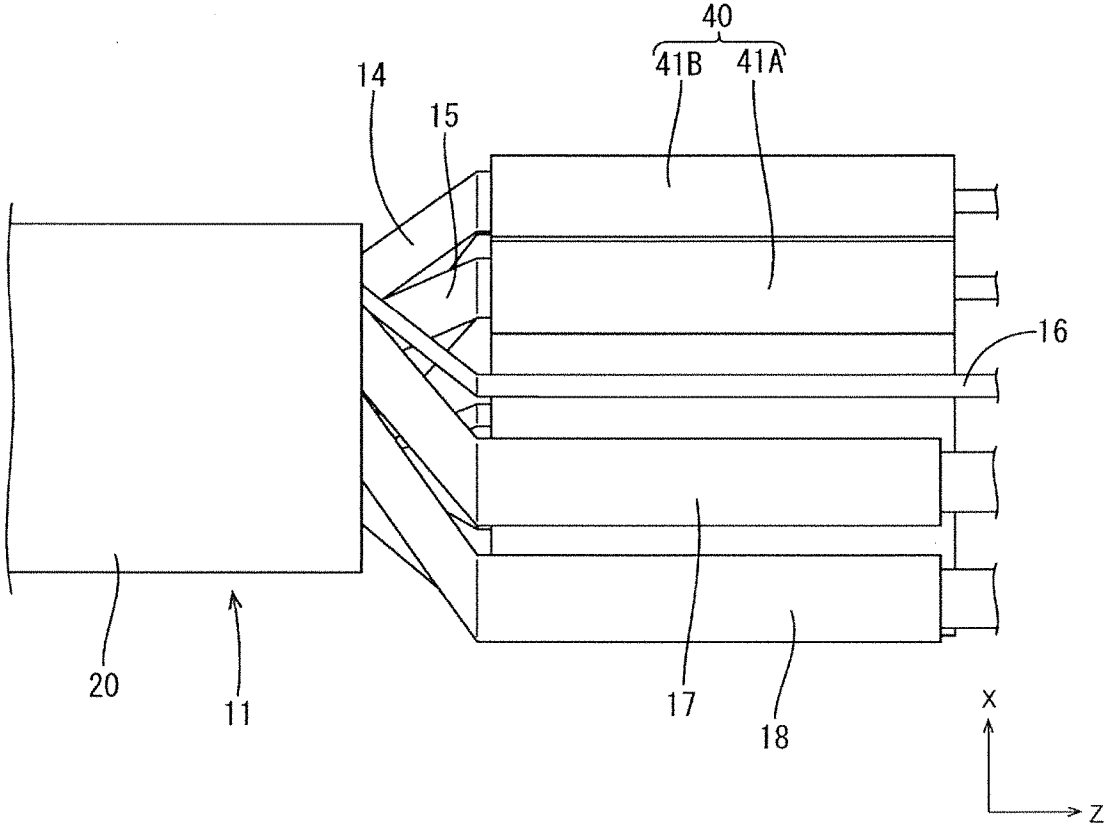
FIG. 4 is a plan view showing a cable having a wire holding member mounted thereon.
Figure 5:
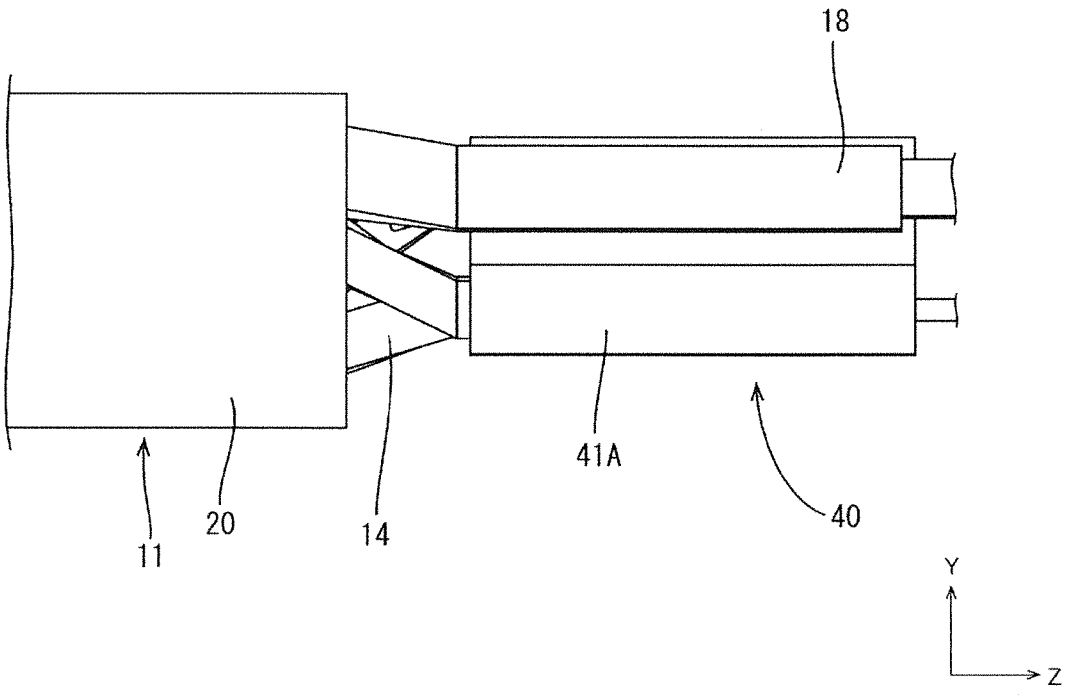
FIG. 5 is a side view showing the cable having the wire holding member mounted thereon.

As shown in FIGS. 2 and 3, the communication connector 30 includes terminals 31, a housing 35, a wire holding member 40 and a shield case 60.

(Terminal 31)

The terminal 31 has opposite front and rear ends. A terminal connecting portion 32 is formed at the front end, and a plate-like wire connecting portion 33 is formed integrally behind the terminal connecting portion 32. The terminal connecting portion 32 is rectangular and has a resilient contact piece configured to contact a mating male terminal. The conductor 19A exposed from the wire 12 to 18 is, for example, soldered and connected to the wire connecting portion 33 using solder S. Note that the connection of the conductor 19A to the wire connecting portion 33 is not limited to soldering and another known connection method may be used. For example, the conductor portion 19A may be connected to the wire connecting portion 33 by ultrasonic welding, laser welding or the like.

(Housing 35)

The housing 35 is made of insulating synthetic resin and includes a body 36 for accommodating the terminal connecting portions 32 of the respective terminals 31 and an extending portion 38 extending rearward of the body 36 and having a smaller vertical thickness than the body 36. The body 36 has a rectangular parallelepiped shape, and five cavities 37 for accommodating the terminal connecting portions 32 are arranged side by side at intervals in the lateral direction in each of upper and lower stages in the body 36. Each cavity 37 has a rectangular cross-section corresponding to the outer peripheral shape of the terminal connecting portion 32 and extends in a front-rear direction according to a length of the terminal connecting portion 32. The terminal connecting portion 32 has movements in the front-rear direction restricted by being locked inside the cavity 37. The extending portion 38 is a plate extending rearward from a vertically intermediate part of the rear end of the body 36, and groove-like recesses are formed side by side in the lateral direction on each of the top and bottom surfaces of the extending portion 38 according to the number of the terminals 31. The wire connecting portions 33 are fit into these recesses. Note that the terminals 31 in the lower stage are mounted in the housing 35 while being held in an orientation turned upside down from that of the terminals 31 in the upper stage.

(Wire Holding Member 40)

The wire holding member 40 is disposed to be connected to and behind the extending portion 38 and includes left and right wire accommodating portions 50 each in the form of a rectangular tube for surrounding two adjacent second wires 14, 15 and a coupling portion 51 coupling the two diagonally arranged wire accommodating portions 50. This wire holding portion 40 has two identically shaped dividing members 41A, 41B.

Figure 6:
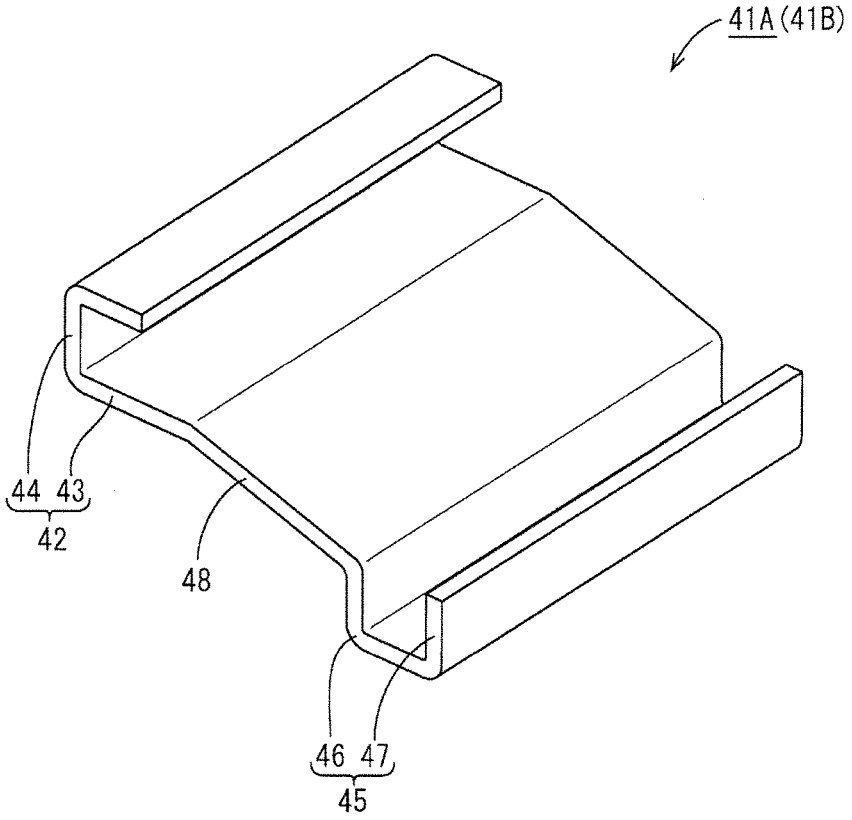
FIG. 6 is a perspective view showing a dividing member.
Figure 7:
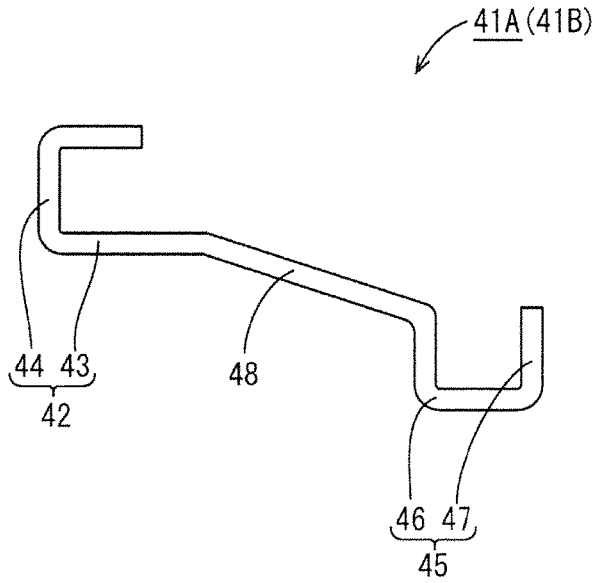
FIG. 7 is a back view of the dividing member.

The dividing member 41A, 41B is formed by applying stamping and bending to a metal plate material, such as aluminum, aluminum alloy, copper or copper alloy, and includes, as shown in FIGS. 6 and 7, a first wall 42 for partitioning between the outer second wire 14, 15 and outside, a second wall 45 for partitioning between the adjacent second wires 14, 15, and a coupling plate 48 coupling the first and second walls 42, 45.

The first wall 42 includes a bottom plate 43 and an L-shaped outer wall 44 rising perpendicularly from the bottom plate 43. The second wall 45 includes an outer wall 46 bent at an end part of the coupling plate 48 and L-shaped, and a partition 47 bent perpendicularly from a tip part of the outer wall 46. The partition 47 is disposed between the adjacent second wires 14, 15 to partition between the adjacent second wires 14, 15.

The wire accommodating portion 50 is formed by assembling the first wall 42 of one dividing member 41A (41B) and the second wall 45 of the other dividing member 41B (41A). Thus, the second wires 14, 15 are surrounded by the wire accommodating portion 50 with the dividing members 41A, 41B assembled. The coupling portion 51 is configured by overlapping the coupling plates 48, 48. By disposing the second wires 14, 15 on one dividing member 41A (41B) and assembling the other dividing member 41B (41A), the second wires 14, 15 can be assembled with the wire accommodating portion 50. Note that, without limitation to this, the second wires 14, 15 may be passed through openings of the wire accommodating portions 50 after the dividing members 41A, 41B are assembled.

(Shield Case 60)

The shield case 60 is made of metal, such as aluminum or aluminum alloy and includes, as shown in FIG. 1, a first shield case 61 in the form of a rectangular tube that covers the body 36 of the housing 35 and a second shield case 63 disposed behind the first shield case 61 for covering the wires 12 to 18 and the wire holding member 40. The second shield case 63 is in the form of a box with an open front and includes, on a rear end part, a cylindrical shield connecting portion 64 to be fit externally on the cable 11. The shield connecting portion 64 is, for example, connected to the shield layer folded to the outside of the coating 20 at the end part of the cable 11, such as by welding or crimping. The wire holding member 40 is inserted through the second shield case 63 with a tiny clearance defined therebetween. Thus, the dividing members 41A, 41B are held in an assembled state in the second shield case 63 and their separation is restricted.

According to this embodiment, relative positions of the second wires 14, 15 on the one end of the first wire row 22A in the arrangement direction in the wire row 22A and the second wires 14, 15 on the opposite end of the second wire row 22B in the arrangement direction are held by the wire holding member 40, and the second wires 14, 15 are surrounded by the wire holding member 40. This enables the second wires 14, 15 disposed at diagonal positions in the different wire rows 22A, 22B to be shielded around while their relative positions are held. Therefore, potentials among the wires 12 to 18 can be stabilized and impedance changes of the wires 12 to 18 can be suppressed for parts among the wires 12 to 18 where impedance easily changes. Thus, the reflection of signals at impedance change points can be suppressed, and a reduction of communication quality can be suppressed. Particularly, signals of the second wires 14, 15 for transmitting high-speed signals easily can be degraded by being reflected or radiated. However, according to this embodiment, degradation caused by the reflection or radiation of the signals can be suppressed.

Further, the wire holding member 40 is configured to surround the second wires 14, 15 with the dividing members 41A, 41B assembled. Thus, an operation of assembling the second wires 14, 15 with the wire holding member 40 can be simplified.

Further, if the terminals 31 were arranged in a row in the housing 35, the communication connector 30 would be long in the arrangement direction of the terminals 31. Thus, an arrangement space could be restricted. On the other hand, according to this embodiment, the terminals 31 can be arranged in plural rows by arranging the wire rows 22A, 22B in parallel. Thus, the communication connector 30 has a compact shape and the arrangement space is less likely to be restricted.

Further, each wire row 22A, 22B includes the adjacent second wires 14, 15 and each dividing member 41A, 41B includes the first wall 42 that partitions between the outer second wire 14, 15 and the outside, while the second wall 45 partitions between the adjacent second wires 14, 15.

Accordingly, impedance changes of the wires 12 to 18 can be suppressed by a simple configuration.

<Second Embodiment>

A second embodiment is described with reference to FIGS. 9 to 13.

In a communication connector of the second embodiment, the shapes of dividing members 71A, 71B in a wire holding member 70 are changed. Since the other components are the same as in the first embodiment, the same components as in the first embodiment are denoted by the same reference signs and not described below.

Figure 9:
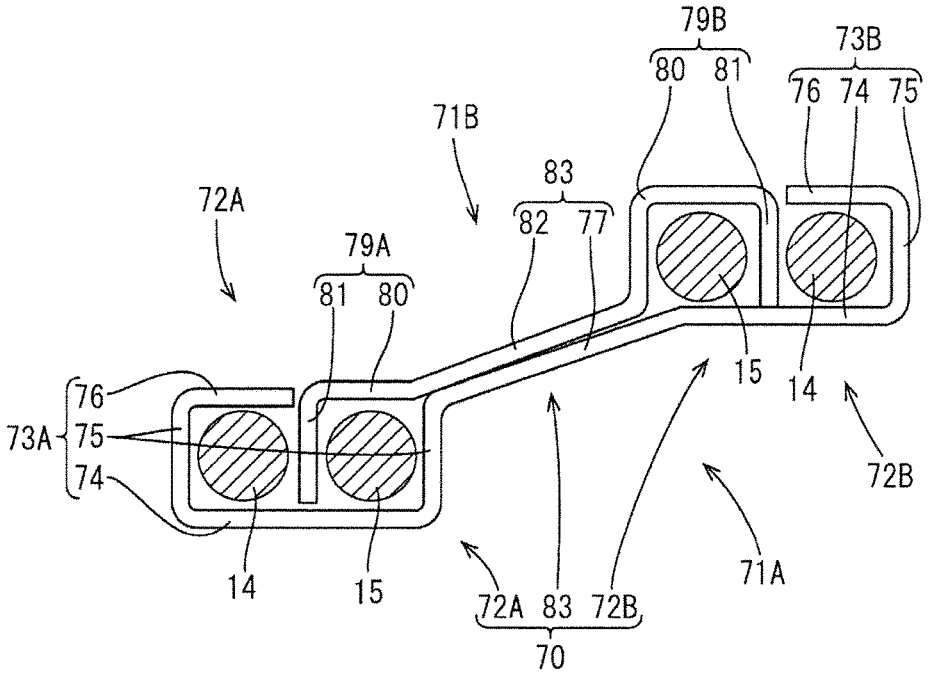
FIG. 9 is a front view showing a state where a plurality of second wires are held in a wire holding member of a second embodiment.
Figure 10:
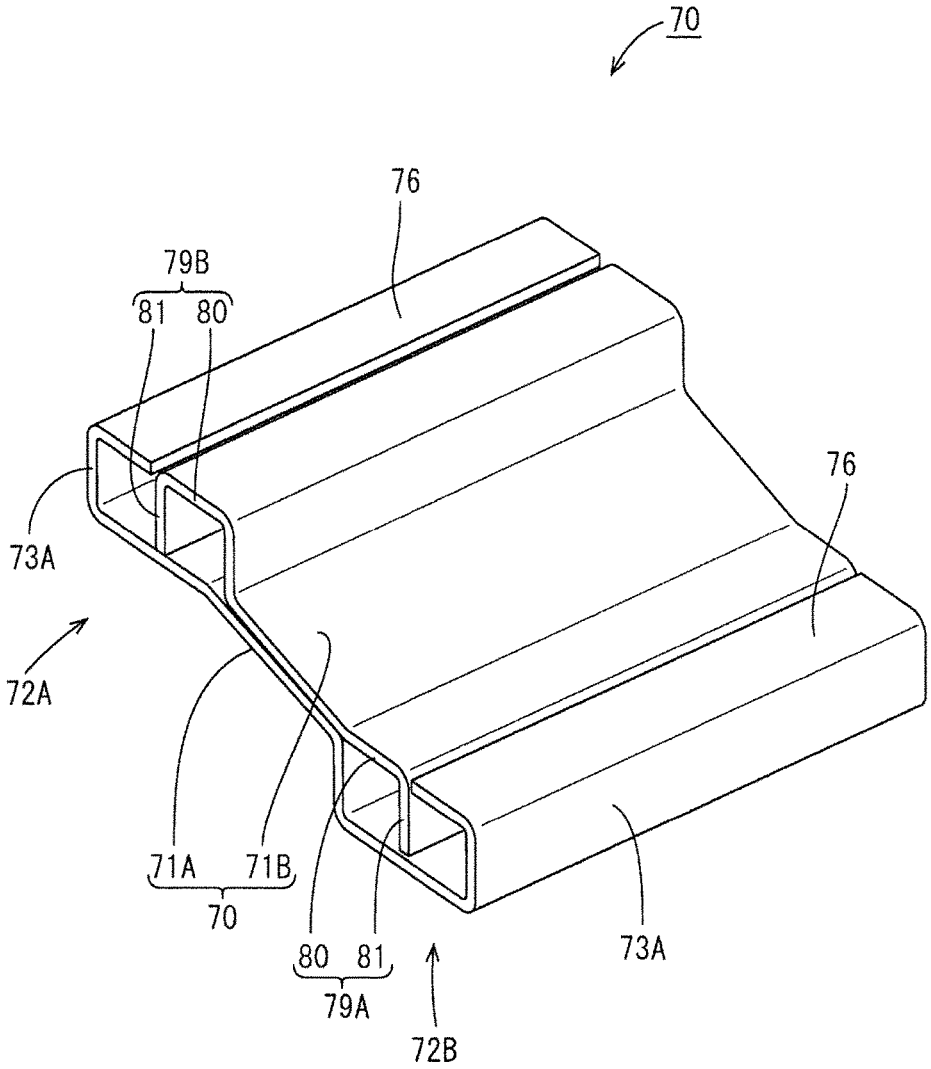
FIG. 10 is a perspective view showing the wire holding member.
Figure 11:
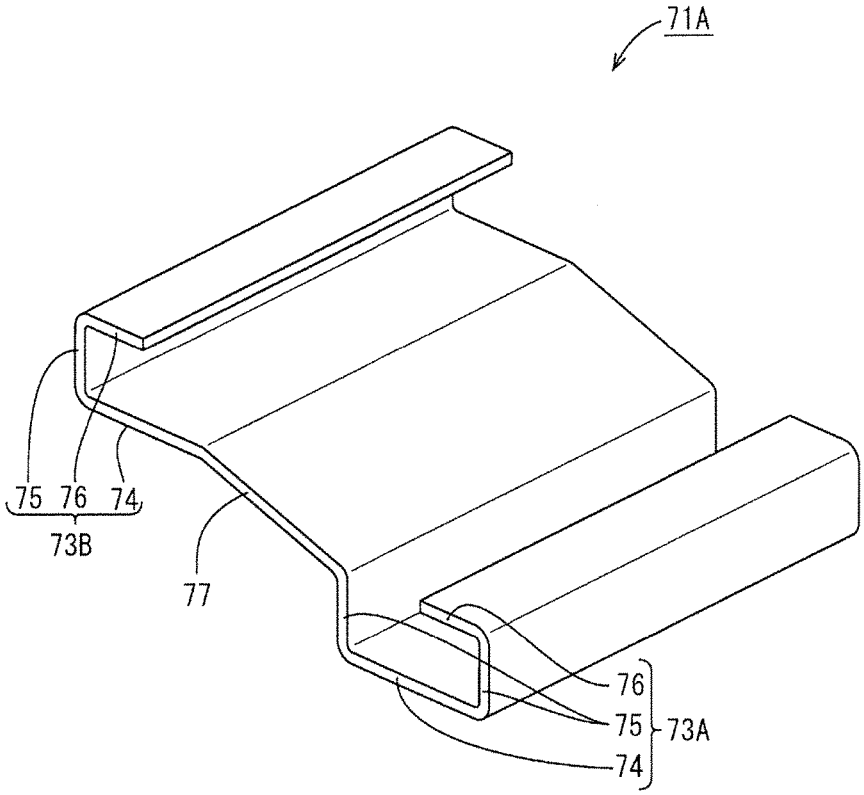
FIG. 11 is a perspective view showing one dividing member.
Figure 12:
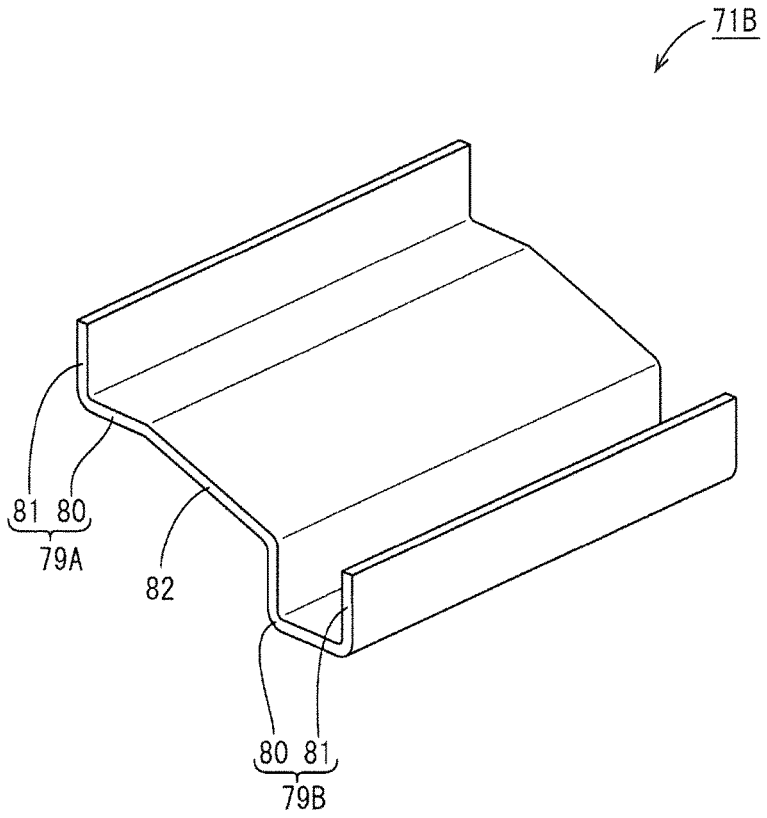
FIG. 12 is a perspective view showing another dividing member.

The wire holding member 70 is formed by applying stamping and bending to a metal plate material, such as aluminum, aluminum alloy, copper or copper alloy. The wire holding member 70 includes, as shown in FIG. 9, left and right wire accommodating portions 72A, 72B that individually surround two second wires 14, 15 and a coupling 83 coupling the two diagonally arranged wire accommodating portions 72A, 72B. This wire holding portion 70 is composed of two dividing members 71A, 71B, as shown in FIG. 10. One dividing member 71A includes left and right first walls 73A, 73B disposed outside the second wires 14, 15 and a coupling plate 77 coupling the diagonally arranged first walls 73A, 73B, as shown in FIG. 11. The first wall 73A, 73B includes a placing portion 74 on which the second wires 14, 15 are placed, a side wall 75 rising perpendicularly from an end part of the placing portion 74 and a lid 76 folded perpendicularly toward the placing portion 74 from an end part of the side wall 75.

The other dividing member 71B is shaped to be fit into the dividing member 71A and includes two second walls 79A, 79B for partitioning between the second wires 14, 15 and a coupling plate 82 coupling the second walls 79A, 79B. The second wall 79A, 79B includes a lid 80 for covering the second wire 15 and a partitioning portion 81 for partitioning between the second wires 14, 15. The wire accommodating portions 72A, 72B are formed by assembling the first walls 73A, 73B and the second walls 79A, 79B and the coupling portion 83 is configured by overlapping the coupling plates 77, 82.

Figure 13:
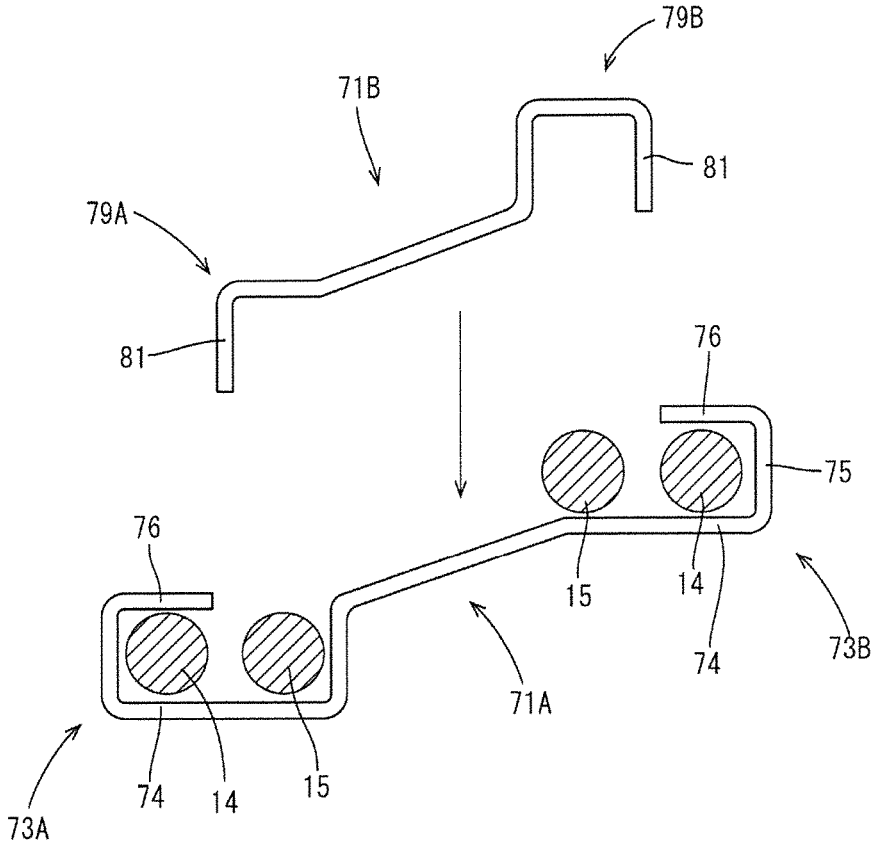
FIG. 13 is a diagram showing the process of placing the second wires on the one dividing member and assembling the other dividing member.

The second wires 14, 15 are placed on the placing portions 74 on both left and right sides of the dividing member 71A and the dividing member 71B is put from above, as shown in FIG. 13. The dividing member 71B then is mounted inside the dividing member 71A to form the wire holding member 70, and the second wires 14, 15 are partitioned by the partitioning portions 81 (see FIG. 9).

In the communication connector of the second embodiment, each wire row 22A, 22B includes the adjacent second wires 14, 15 and one dividing member 71A includes first walls 73A, 73B each for partitioning the outer second wire 14 in each wire row 22A, 22B and the outside. The other dividing member 71B includes second walls 79A, 79B for partitioning between the adjacent second wires 14, 15 in each wire row 22A, 22B. By doing so, an assembling operation in disposing and assembling wires 12 to 18 between the dividing members 71A, 71B can be facilitated.

<Other Embodiments>

The invention is not limited to the above described embodiments. For example, the following embodiments also are included in the scope of the invention.

Although two dividing members 41A, 41B; 71A, 71B constitute the wire holding member, there is no limitation to this and three or more dividing members may constitute a wire holding member. Further, the shapes of the dividing members are not limited to those of the above embodiments and can be changed to various shapes.

The number of the wires 12 to 18 is not limited to the one described above and may be a different number.

Although the second wires 14, 15 are arranged on the end parts of the wire rows 22A, 22B in the arrangement direction, the second wires 14, 15 may not be arranged on the end parts of the wire rows in the arrangement direction if the second wires 14, 15 of the wire rows are positioned substantially diagonally. For example, the second wires 14, 15 may be arranged on a side closer to the end part than a middle part in the arrangement direction. In this case, other wire(s) may be arranged on a side (outer side) closer to the end part than the second wires 14, 15 in the arrangement direction.

The dividing member 41A, 41B (71A, 71B) may be provided with a locking portion to be locked to a mating locking portion when the dividing members 41A, 41B (71A, 71B) are assembled, so that the separation of the dividing members 41A, 41B (71A, 71B) is restricted.

LIST OF REFERENCE SIGNS

10: communication connector with wires
11: cable
12 to 18: wire
12, 13: first wire
14, 15: second wire
15: second wire
22A, 22B: wire row
30: communication connector
31: terminal
35: housing
40, 70: wire holding member
41A, 41B, 71A, 71B: dividing member
42, 73A, 73B: first wall
45, 79A, 79B: second wall
60: shield case

The invention claimed is:

1. A communication connector having opposite first and second lateral sides, comprising:

first terminals connected respectively to first wires and two pairs of second terminals connected respectively to two pairs of second wires, the wires forming first and second wire rows with a first of the pairs of second wires being in the first row and with a second of the pairs of second wires being in the second row;

a housing for accommodating the terminals; and a conductive wire holding member for holding relative positions of the first of the pairs of the second wires on the first side of the connector and in the first wire row and for holding relative positions of the second of the pairs of the second wires on the second side of the connector and in the second wire row so that the first and second pairs of the second wires are laterally offset from one another;

the wire holding member being composed of first and second dividing members that are assembled with one another, the wire holding member being configured to surround each of the second wires with the dividing members assembled.

2. The communication connector of claim 1, wherein:

the second wires in the first pair of second wires are adjacent to each other in the first wire row, and the second wires in the second pair of wires are adjacent to each other in the second wire row; and the dividing members includes a first partition wall partitioning the second wires in the first pair of second wires and a second partition wall partitioning the second wires in the second pair of second wires.

3. The communication connector of claim 1, wherein:

the second wires in the first pair of second wires are adjacent to each other in the first wire row, and the second wires in the second pair of wires are adjacent to each other in the second wire row; and the dividing members include a first outer wall between the first pair of the second wires and the first side of the connector and a second wall between the second pair of the second wires and the second side of the connector.

4. The communication connector of claim 1, wherein:

the second wires in the first pair of second wires are adjacent to each other in the first wire row, and the second wires in the second pair of wires are adjacent to each other in the second wire row; and the dividing members include a first partition wall partitioning the second wires in the first pair of the second wires, a second partition wall partitioning the second wires in the second pair of the second wires, a first outer wall between the first pair of the second wires and the first side of the connector and a second outer wall between the second pair of the second wires and the second side of the connector.

5. The communication connector of claim 4, wherein the dividing members further include a first inner wall disposed so that the first pair of the second wires is between the first inner wall and the first side of the connector, and a second inner wall disposed so that the second pair of the second wires is between the second inner wall and the second side of the connector.

6. The communication connector of claim 5, wherein the first dividing member includes the first and second partition walls, and the second dividing member includes the first and second outer walls.

7. The communication connector of claim 6, wherein the first dividing member includes the first inner wall and the second dividing member includes the second inner wall.

8. The communication connector of claim 1, wherein the first dividing member includes the first partition wall, the first inner wall and the second outer wall, and the second dividing member includes the second partition wall, the second inner wall and the first outer wall.

9. The communication connector of claim 1, wherein the first wires are in the first wire row at a position between the second wires in the first wire row and the second side of the connector.

* * * * *